United States Patent [19]

Boyd

[11] Patent Number: 4,998,081

[45] Date of Patent: Mar. 5, 1991

[54] POWER INTERRUPTER WITH FORCE-SENSITIVE CONTACT LATCH

[75] Inventor: Donald R. Boyd, Sanford, N.C.

[73] Assignee: Siemens Energy & Automation, Inc., Alpharetta, Ga.

[21] Appl. No.: 353,589

[22] Filed: May 18, 1989

[51] Int. Cl.[5] ..... H01H 75/00

[52] U.S. Cl. ..... 335/6; 335/16; 335/195

[58] Field of Search ..... 335/6, 16, 147, 195; 200/147 R

[56] References Cited

U.S. PATENT DOCUMENTS 4,237,923 12/1980 Pressaco .
4,307,752 12/1981 Inada .
4,413,244 11/1983 Hafner .
4,454,490 6/1984 Belbel et al. ..... 335/195

FOREIGN PATENT DOCUMENTS 2442457 3/1976 Fed. Rep. of Germany .
2938437 4/1981 Fed. Rep. of Germany .
3133285 8/1981 Fed. Rep. of Germany .
3236535 4/1984 Fed. Rep. of Germany .
3541942 8/1986 Fed. Rep. of Germany .
3701019 7/1988 Fed. Rep. of Germany .
3725385 2/1989 Fed. Rep. of Germany .
3742830 7/1989 Fed. Rep. of Germany .

*Primary Examiner*—Gerald P. Tolin
*Assistant Examiner*—Lincoln Donovan
*Attorney, Agent, or Firm*—Peter A. Luccarelli, Jr.; James G. Morrow

[57] ABSTRACT

A low voltage electrical power circuit breaker in which an actuator in the form of a pushrod controls the separation of arcing contacts by an actuating mechanism; a force-actuated mechanical latching assembly is interposed between the pushrod and the actuating mechanism. Under fault current conditions, the current-induced force tending to open the contacts exerts sufficient force on the latch assembly to unlatch it, thereby permitting the contacts to open freely on their own, without waiting for the operation of the actuating mechanism.

10 Claims, 3 Drawing Sheets

POWER INTERRUPTER WITH FORCE-SENSITIVE CONTACT LATCH

TECHNICAL FIELD

The invention relates to electrical power protection devices which interrupt the power under prescribed conditions and relates particularly to low voltage circuit breakers.

BACKGROUND OF THE INVENTION

Circuit breakers for industrial use are classified by, among other characteristics, their interrupt rating and their fault current capability. Operation of the breaker involves the separation of arcing contacts of each phase by an actuating mechanism which is triggered by a tripping device. The actuating mechanism generally involves the triggered release of a spring-loaded rotating main shaft with short arms attached to pushrods which pull the contacts open when the main shaft opens. The actuating mechanism is designed to minimize the momentum of the moving parts for the mechanical stresses involved, so that the operating time for a tripping function is as short as possible. This is important, since typically, just a single uninterrupted current cycle is capable of passing enough energy to a failing device in the protected circuit to result in costly damage. In circuits where a very large fault current can be passed through the circuit breaker, the time needed for the breaker to exercise its normal tripping function may be long enough to permit the fault current to do serious damage to the equipment which is intended to be protected by the circuit breaker. This is due to the momentum of the relatively massive mechanical parts which must be moved in the course of a tripping operation. Therefore, it is common practice to locate a power fuse on the power supply side of the circuit breaker to deal with such situations in a controlled manner. The disadvantage of such an arrangement is that power fuses take up additional cabinet space, are relatively expensive, and require manual replacement for each fuse operation. Therefore, there is a need for a circuit breaker which is capable of reacting in a very short time to high fault currents.

SUMMARY OF THE INVENTION

In accordance with the present invention, a novel circuit breaker is provided with a force-activated mechanical latching member connected to the contact actuating member. In response to a high fault current, the repulsion force of the breaker contacts push against the latching member and cause it to yield, thereby resulting in a tripping of the breaker contacts by their own mutual repulsion force independently of the operation of the tripping mechanism of the breaker. As a result, the fault tripping time of the breaker is significantly shortened to permit fault current operations without the operation of a supply side power fuse.

DETAILED DESCRIPTION

Figure 1A:
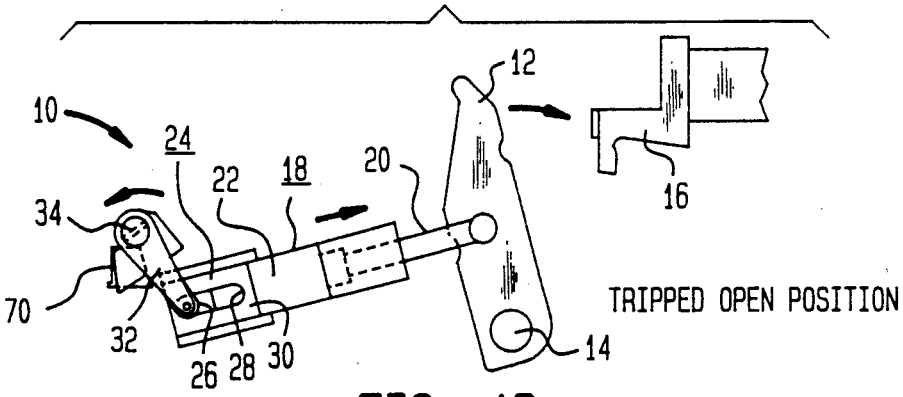
Figure 1B:
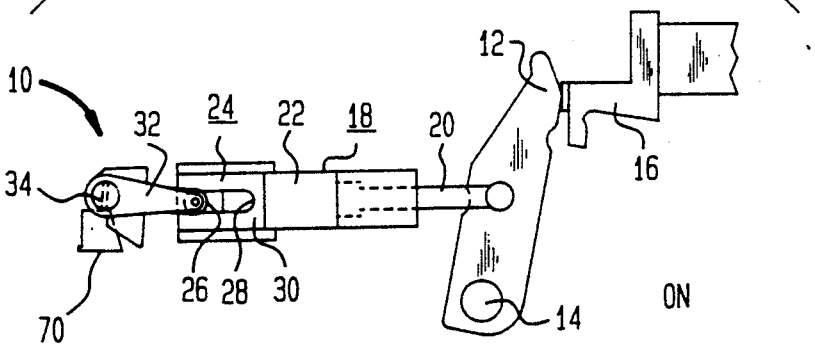

In the FIGS. 1A, 1B, 1C, and 1D of the drawings there is shown schematically the actuation of a novel low voltage circuit breaker mechanism 10 in accordance with the present invention. The elements of the breaker 10 are provided with reference numerals only in the FIG. 1A, since the elements in the other figures are changed positionally only. Referring to FIG. IA, which shows the breaker mechanism 10 in a tripped, open position, a movable primary circuit arcing contact 12, which pivots on a contact shaft 14 is pulled away from a stationary primary circuit arcing contact 16 by an actuating member (also known as a latching assembly) 18 in the form of a pushrod 20 attached to a clevis member 22. .The pushrod clevis member 22 has fixed in its end remote from the movable contact 12 a force-actuated mechanical latching assembly 24 including a hardened steel latch block 26 which slides along a slot 28 through a split steel casing 30 in the direction of the longitudinal axis of the pushrod 20. The latch block 26, in turn, is coupled to an actuating arm 32 of a main shaft 34. The circuit breaker mechanism 10 also has a stop block 70.

The FIG. IB shows the breaker 10 in the closed, set position, with the main shaft 34 having been rotated a partial revolution counterclockwise to bring the actuating arm 32 into alignment with the clevis member 22 and pushrod 20. This presses the arcing contacts 12,16 together for normal circuit operation. In this position, the main shaft 34 is biased by a powerful spring, not shown, to rotate clockwise, but is held in the cocked position by a mechanical trigger, also not shown. The trigger is tripped under the control of a tripping circuit which operates an electromechanical tripping mechanism. It should be understood that typically each phase of the breaker 10 would have a separate set of primary circuit arcing contacts and would likewise be served by an actuating mechanism of the type being described attached to the same main shaft 34. Since the actuating mechanisms for all phases would ordinarily be identical, the description will in the interest of simplicity focus on only a single phase of the breaker 10.

Figure 1C:
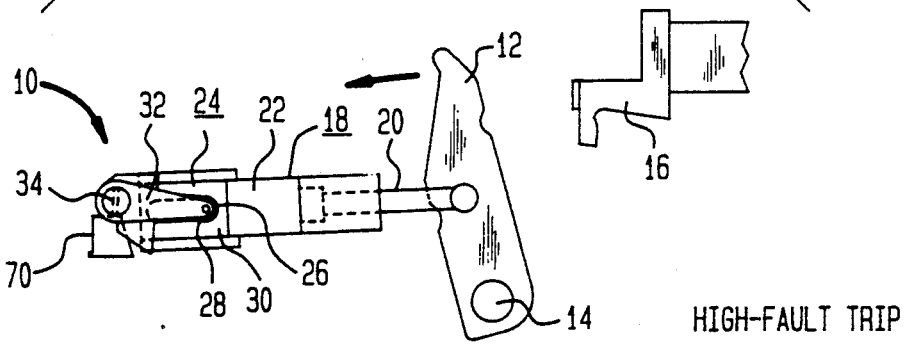

In FIG. 1C there is illustrated the action of the breaker 10 under high fault current conditions. High currents have the effect of tending to force the contacts 12,16 apart, thereby putting a linear force on the pushrod 20 in the direction of the main shaft 34. The force-actuated latching assembly 24 reacts by releasing the latch block 26 when a predetermined force has been exceeded and thereby permitting the clevis member 22 and pushrod 20 to move toward the main shaft 34 to open the contacts 12, 16, even though at this point the main shaft 34 may not have undergone any rotation. Because of the relatively large momentum of the main actuating mechanism associated with the main shaft 34, the tripping of the main shaft 34 may take considerably longer than the response of the force-actuated latch assembly 24 requires to release. By opening the contacts 12, 16 in a shorter time than that which would be required for the normal tripping operation, the force-actuated latch assembly 24 can interrupt a fault current in a sufficiently short time to prevent the operation of a power fuse associated with the breaker 10, thus saving not only the cost of a replacement fuse, but also the labor cost of installing such a fuse.

Figure 1D:
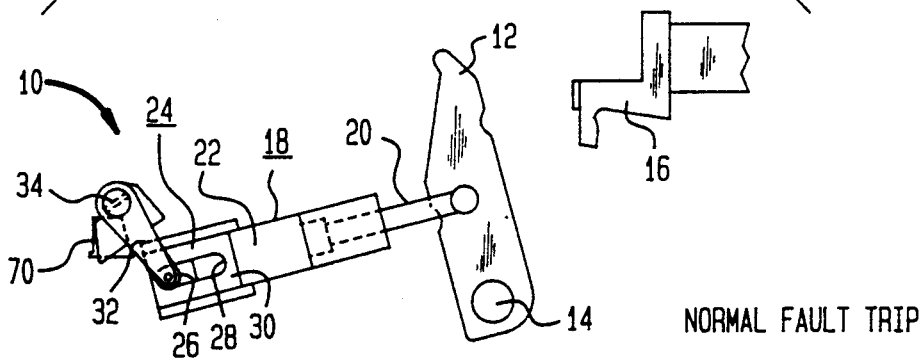

In the FIG. 1D there is shown the rotation of the main shaft 34 in response to a normal tripping of the breaker 10, which follows the operation of the relatively quicker reacting force-actuated latch assembly 24. The clockwise rotation of the main shaft 34 after actuation of the electromechanical tripping mechanism causes the latch assembly 24 to abut the stop block 70. Continued clockwise rotation of main shaft 34 brings the latch block 26 back into its original latched position, i.e., to the left within casing 30. The breaker 10 can now be reset as directed earlier with respect to FIGS. 1A and 1B, by rotating shaft 34 counterclockwise with a cocking mechanism and engaging the mechanical trigger to prevent clockwise rotation of the shaft 34.

Figure 2A:
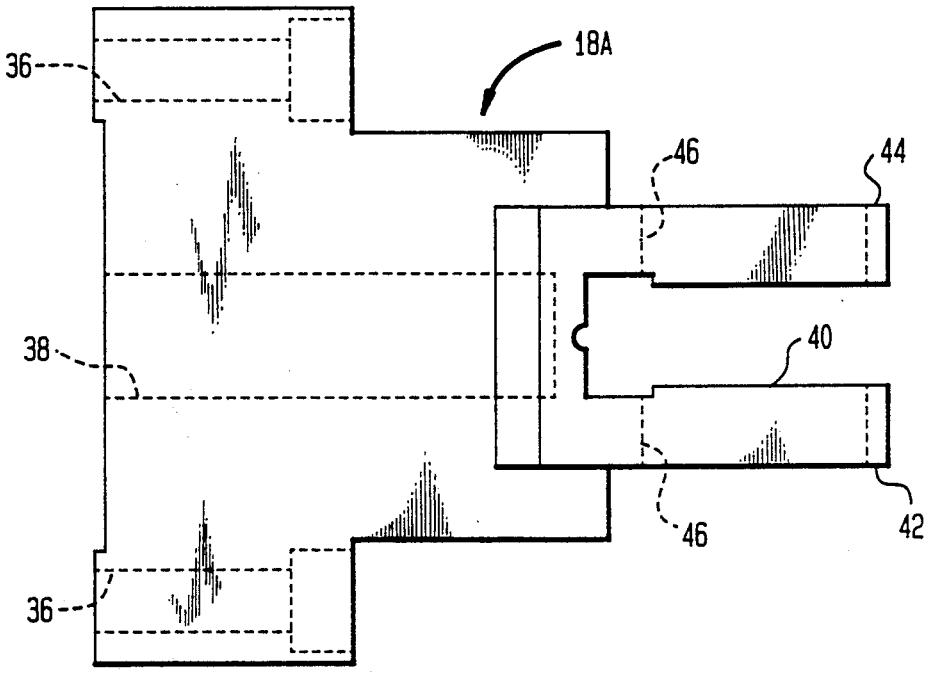
Figure 2B:
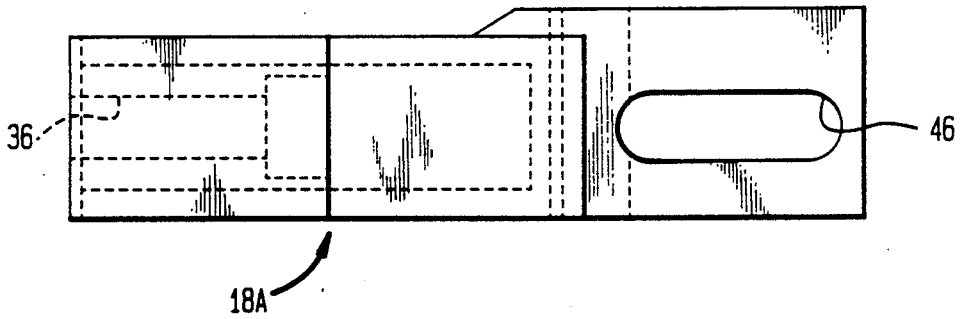
Figure 2C:
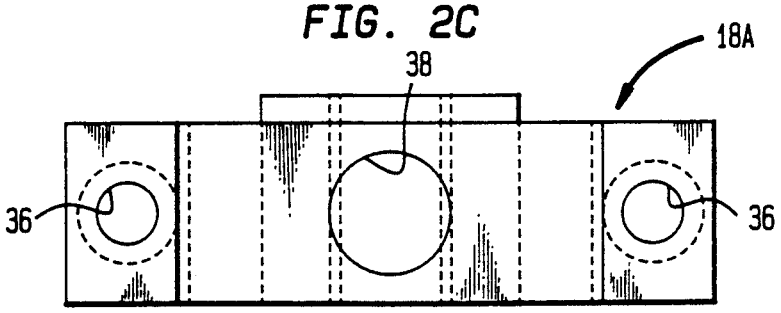

A detailed illustration of an alternate embodiment of an actuating member 18A is shown in FIGS. 2A, 2B, and 2C. The actuating member 18A is made of a glass fiber reinforced thermosetting plastic in such a configuration that it serves as an integral combination of clevis member and pushrod and has an arcing contact assembly, not shown, mounted to its end remote from the main shaft 34 by means of screws passing through the mounting holes 36. An opening 38 centered in the contact end provides a receptacle for a contact bias spring, not shown, which determines the closed contact pressure. At the other end of the actuating member 18A there is a clevis type latch assembly receptacle 40 defined by first and second arms 42,44. In each arm 42,44 there is a guide slot 46.

Figure 3A:
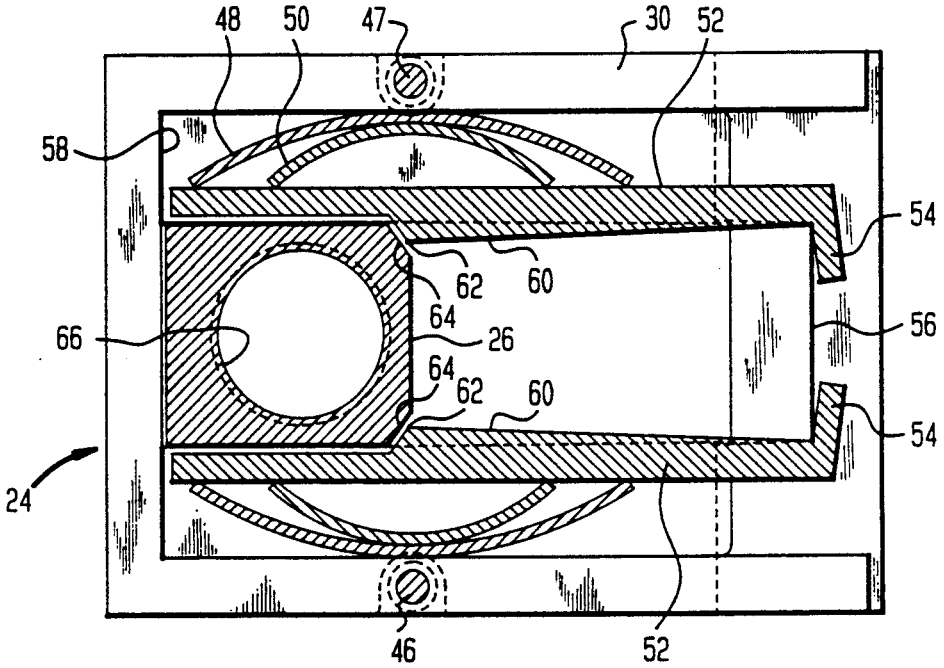
Figure 3B:
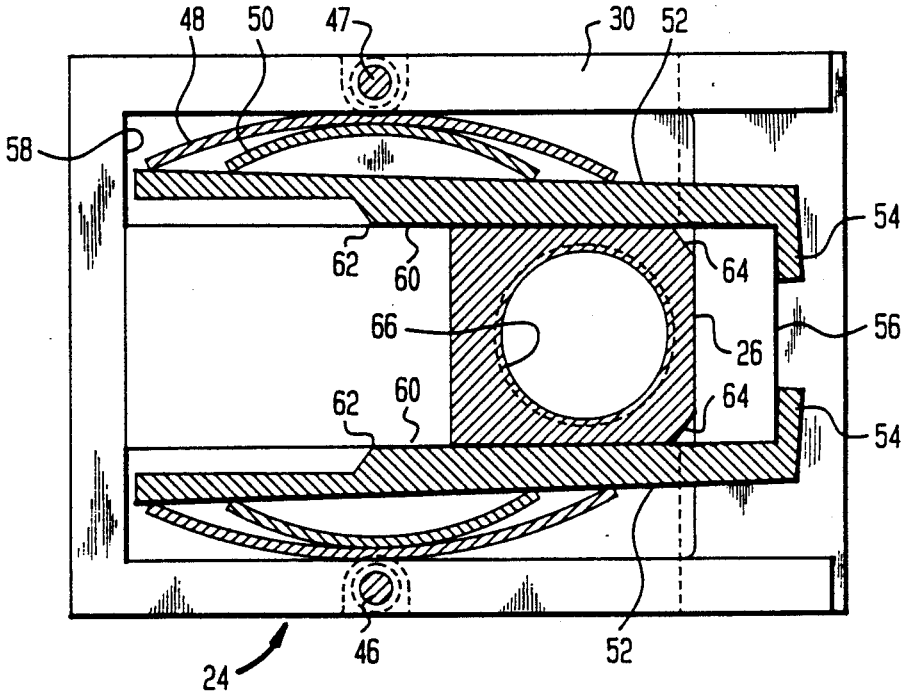

The geometry of the latch receptacle 40 is matched to the exterior geometry of the latch assembly 24, shown in more detail in FIGS. 3AA and 3B with its latch block 26 in the two different positions, so that the latch block 26 moves within the clearance provided by the slots 28 of the split steel casing 30 and the corresponding slots 46 in the arms of the latch receptacle arms 42,44. Two halves of the casing 30 held together by rivets 47 house two opposing sets of leaf springs 48, 50, with the former having a larger radius of curvature, situated in wells adjacent the guide slot 28 along which the latch block 26 can move. Between the latch block 26 and the springs 48, 50 are two identical hardened steel latches 52 in the form of arms with end tabs 54 extending around the edges of a crosspiece 56 at one end of the casing 30. The other end of the latches 52 is just clear of the end wall 58 of the casing 30 to reduce friction when the latches 52 swing about their retained ends at the crosspiece 56. The inwardly facing side of the latches 52 has a raised portion 60 with a steep locking incline 62 at a point along its length which permits it to engage a beveled corner 64 of the latch block 26 when it is in the latched position. The pressure of the springs 48,50 forcing the latching incline 62 against the beveled corner 64 of the block 26 prevents movement of the block 26 along the casing slot 28 until the block 26 is urged in that direction by a force exceeding a predetermined threshold. The threshold force is determined by the choice of the locking incline 62 and bevel 64 angle and the spring force exerted on the latches 52. Once the threshold is overcome, the latches 52 swing away from the block 26 into the spring recesses to clear the latching incline 62 from the beveled block corners 64 and permit the block 26 to slide unimpeded to the other end of the casing slot 28.

The latch bias springs 48,50 are arcuate, with their concave side toward the hardened latches 52 to prevent the ends from digging into the soft steel casing 30. Various other spring arrangements would be readily apparent to those skilled in the art for providing the bias to the latches. The springs could conceivably be coil springs, for example.

The opening 66 through the latch block 26 is suited for fastening the actuating member 18, with the latching assembly 24 installed, to the main actuating mechanism of a breaker by means of a wrist pin passing through the opening 66 and coupling the latching block 26 to the actuating arm 32 of the main shaft 34 in a typical manner. The only significant change needed in the breaker mechanism is provision of the latching assembly 24 in the actuating member 24.

The invention is not limited to any particular design of the latch assembly, but is intended to include any arrangement in which there is interposed between the main actuating mechanism and the arcing contacts a device which yields in response to a predetermined contact opening force to permit the contacts to open for breaking the circuit. Force threshold means other than an inclined plane are contemplated.

I claim:

1. An electrical power interrupter, comprising:

first and second interrupting contact members which are separable from each other for interrupting current;

an actuating member fastened to one of the contact members for separating the contact members from each other;

an actuating mechanism attached to the actuating member for imparting mechanical tripping motion to the actuating member for a tripping operation; and a force-activated mechanical tripping latch coupled between the actuating mechanism and the actuating member, the latch being responsive to force exerted on the actuating member when high current is passed through he contact members, the latch having:

a latch case having an elongated slot through it, the slot longitudinal axis extending in a direction generally parallel to the direction of movement of the actuating arm when the contacts begin to open, a latch block in the slot and slidable along the slot, and a locking incline on the latch case along the slot which is biasable against a corner of the latch block, for holding the latch block at a first end of the slot against a predetermined force for moving the latch block to a second end of the slot and for releasing the block to permit it to move to the second end of the slot when the predetermined force is exceeded.

2. The device according to claim 1, wherein the case is of split construction.

3. The device according to claim 2, wherein the case comprises an opposing pair of latches within the longitudinal walls of the slot, the latches being biased toward the latch block by means of springs between them and the case and also having on their surface toward the slot opening a locking incline which engages a beveled corner of the block.

4. The device according to claim 3, comprising means for holding the latches in position longitudinally when the block is moved into its latched position.

5. The device according to claim 4, wherein the means for holding the latches in position are retaining tabs at the ends of the latches which engage a portion of the case so that the latches may pivot in a limited fashion, but cannot move longitudinally along the slot with the block when the block is moved into the latched position.

6. The device according to claim 5, wherein the bevel of the corner of the block is generally parallel to the surface of the locking incline of the latches.

7. The device according to claim 6, wherein the springs between the latches and the case are leaf springs.

8. The device according to claim 7, wherein the leaf springs are arcuate, with their concave side toward the slot.

9. The device according to claim 8, wherein the leaf springs are compound structures including a plurality of leaves with different radii of curvature.

10. The device according to claim 9, wherein each of the leaf springs comprises two springs.

* * * * *